US007195510B2

(12) United States Patent
Wakefield et al.

(10) Patent No.: US 7,195,510 B2
(45) Date of Patent: Mar. 27, 2007

(54) ELECTRICAL CONNECTOR SYSTEMS WITH LATCHING ASSEMBLIES AND METHODS THEREOF

(75) Inventors: Scott Wakefield, Andover, MA (US); William Chura, Medford, MA (US); Benjamin Hermance, Worcester, MA (US); Thomas Eagan, Chelmsford, MA (US); Chad Terry, Lunenburg, MA (US); John Aho, Lunenburg, MA (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 11/227,809

(22) Filed: Sep. 15, 2005

(65) Prior Publication Data

US 2006/0084325 A1 Apr. 20, 2006

Related U.S. Application Data

(60) Provisional application No. 60/610,394, filed on Sep. 16, 2004.

(51) Int. Cl.
*H01R 13/627* (2006.01)

(52) U.S. Cl. ..... 439/354

(58) Field of Classification Search ..... 439/218, 439/353, 354, 357, 358
See application file for complete search history.

(56) References Cited

U.S. PATENT DOCUMENTS

| | | | | |
|---|---|---|---|---|
| 4,108,527 | A | 8/1978 | Douty et al. | |
| 4,422,706 | A | 12/1983 | Neuhouser | |
| 4,630,876 | A | 12/1986 | Grunberg et al. | |
| 4,857,008 | A | 8/1989 | Kee et al. | |
| 5,254,014 | A | 10/1993 | Yagi et al. | |
| 5,588,870 | A | 12/1996 | Boteler et al. | |
| 5,591,046 | A | 1/1997 | Klein et al. | |
| 5,774,980 | A | 7/1998 | Klein et al. | |
| 5,797,771 | A | 8/1998 | Garside | |
| 6,071,145 | A | 6/2000 | Toly | |
| 6,123,573 | A | 9/2000 | Savicki, Jr. | |
| 6,193,543 | B1 | 2/2001 | Howard et al. | |
| 6,431,887 | B1 | 8/2002 | Yeomans et al. | |
| 6,817,884 | B1 | 11/2004 | Chen et al. | |
| 6,945,807 | B1 * | 9/2005 | Wu | 439/354 |
| 6,991,487 | B2 | 1/2006 | Wu | |
| 7,083,459 | B1 * | 8/2006 | Wu et al. | 439/354 |
| 7,094,089 | B2 * | 8/2006 | Andre et al. | 439/218 |

OTHER PUBLICATIONS

PCT International Search Report dated Dec. 21, 2005 of International Application No. PCT/US05/33382 filed Sep. 16, 2005.
PCT International Search Report dated Jul. 26, 2006 of International Application No. PCT/US05/33149 filed Sep. 16, 2005.

* cited by examiner

*Primary Examiner*—Khiem Nguyen
(74) *Attorney, Agent, or Firm*—Maine & Asmus

(57) ABSTRACT

An electrical connector system with a first connector housing with a first conductive member and a second connector housing with a second conductive member. At least one latch assembly is connected at each end to the first connector housing and has a beam between the ends which extends along and is spaced out from the first connector housing. A projection and an actuation member extends out from the beam of the latching assembly. The second connector housing has an aperture shaped and sized to detachably mate with the projection when the second connector housing with the second conductive member is mated with the first connector housing with the first conductive member. The actuation member is used to release the projection from the aperture when engaged.

10 Claims, 7 Drawing Sheets

ELECTRICAL CONNECTOR SYSTEMS WITH LATCHING ASSEMBLIES AND METHODS THEREOF

This application claims the benefit of U.S. Provisional Patent Application Ser. No. 60/610,394, filed Sep. 16, 2004, which is herein incorporated by reference in its entirety.

FIELD OF THE INVENTION

This invention generally relates to electrical connectors and, more particularly, to electrical connector systems with latching assemblies and methods thereof.

BACKGROUND

A variety of different types of applications require electrical connectors to be connected and disconnected on a regular basis. In these applications, it is important to make sure there is a completed connection between the mated electrical connectors. If the electrical connectors are not completely coupled together, they can accidentally disconnect during use and also can pose a safety hazard.

Additionally, in these applications it is important to make sure the correct electrical connectors are connected together. If the wrong electrical connectors are connected together, they could damage downstream equipment.

SUMMARY

An electrical connector system in accordance with embodiments of the present invention includes a first connector housing with a first conductive member and a second connector housing with a second conductive member. At least one latch assembly is connected at each end to the first connector housing and has a beam between the ends which extends along and is spaced out from the first connector housing. A projection and an actuation member extends out from the beam of the latching assembly. The second connector housing has an aperture shaped and sized to detachably mate with the projection when the second connector housing with the second conductive member is mated with the first connector housing with the first conductive member. The actuation member is used to release the projection from the aperture when engaged.

A method for making a connector system in accordance with other embodiments of the present invention includes providing a first conductive member in a first connector housing and providing a second conductive member in a second connector housing. Each end of at least one latch assembly is connected to the first connector housing while a beam between the ends of the latching assembly extends along and is spaced out from the first connector housing. This beam has a projection and an actuation member which extends out from the beam. The second connector housing has an aperture which is shaped and sized to detachably mate with the projection when the second connector housing with the second conductive member is mated with the first connector housing with the first conductive member. The actuation member is used to release the projection from the aperture when engaged.

A method of making an electrical connection in accordance with other embodiments of the present invention includes mating a first conductive member in a first connector housing with a second conductive member in a second connector housing. A projection on a beam of at least one latch assembly connected to the first connector housing is detachably locked in an opening in the second housing with the mating of the first conductive member in the first connector housing with the second conductive member in the second connector housing. Each end of the latching assembly is connected to the first connector housing and the beam of the latching assembly between the ends extends along and is spaced out from the first connector housing. The projection is released from the aperture with an actuation member which extends out from the beam of the latching assembly to permit the release of the first connector housing with the first conductive member from the second connector housing with the second conductive member.

The present invention provides an electrical connection system with latching assembly which provides a durable and securing detachable locking system. The latching assembly is more durable than prior latches because the opposing ends of the latching assembly are secured. Additionally, the latching assembly prevents over travel during mating and provides increase leverage for actuation of the latching assembly with a stepped beam. Further, the present invention uses a mating system with the latching assembly to ensure the correct electrical connectors are mated together. The present invention also provides an operator an audible and visual indication of a completed electrical connection.

DETAILED DESCRIPTION

Figure 1:
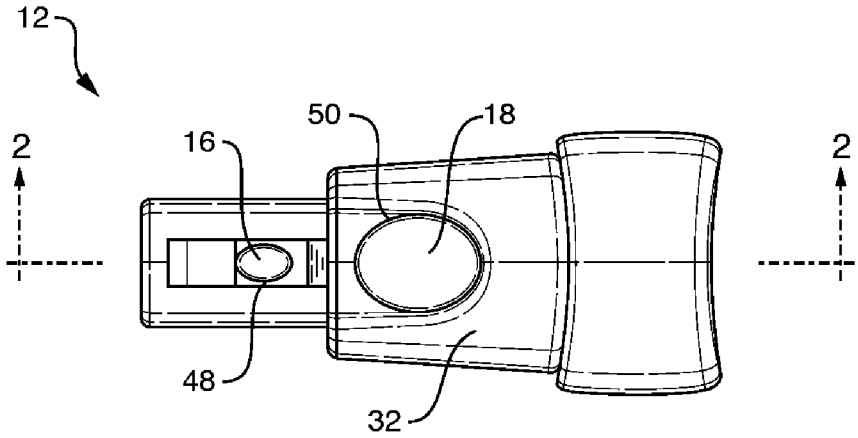
FIG. 1 is a top view of a single pole, female connector with a latch assembly in accordance with embodiments of the present invention.
Figure 2:
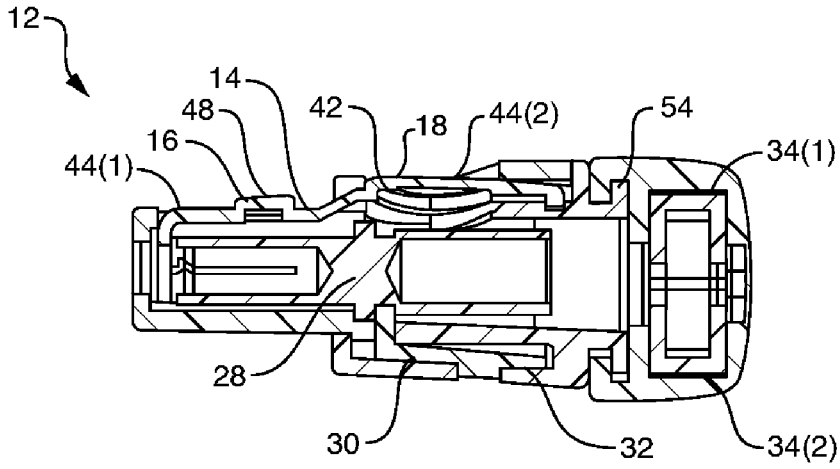
FIG. 2 is a side, cross-sectional view of the single pole, female connector with the latch shown in FIG. 1 taken along lines 2—2.
Figure 3:
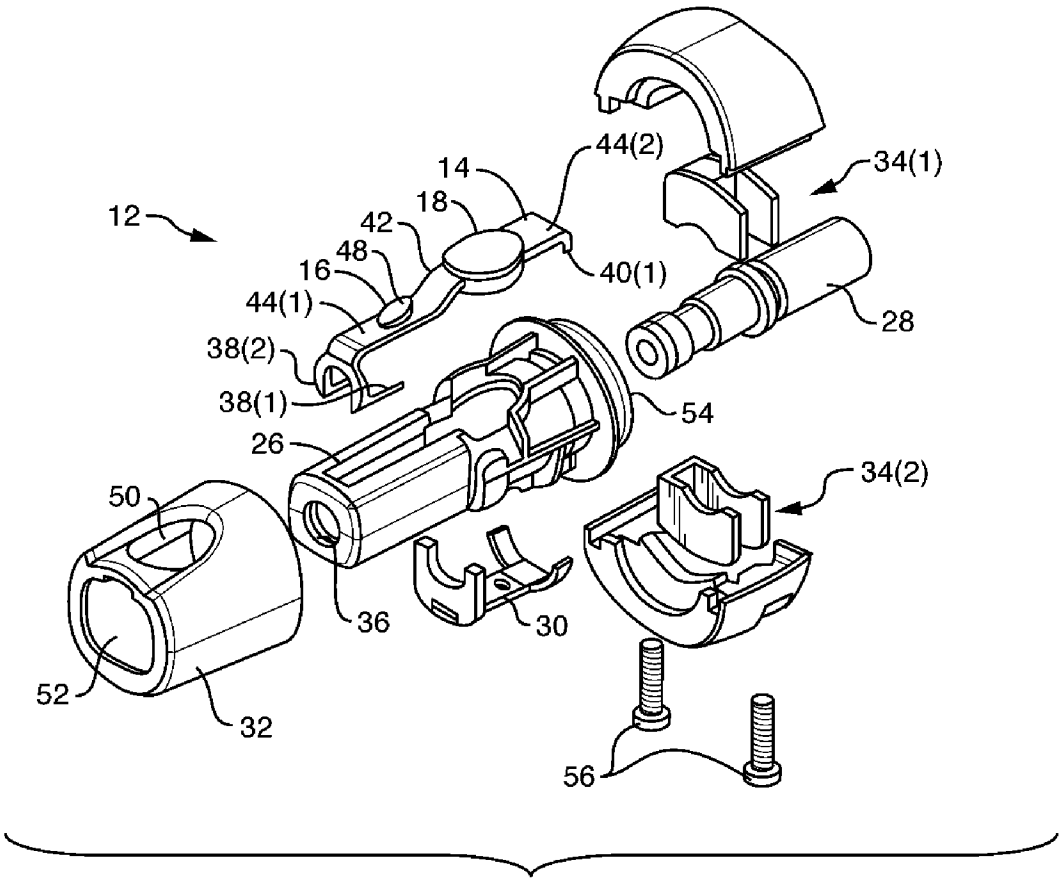
FIG. 3 is an exploded view of the single pole, female connector shown in FIG. 1.
Figure 4A:
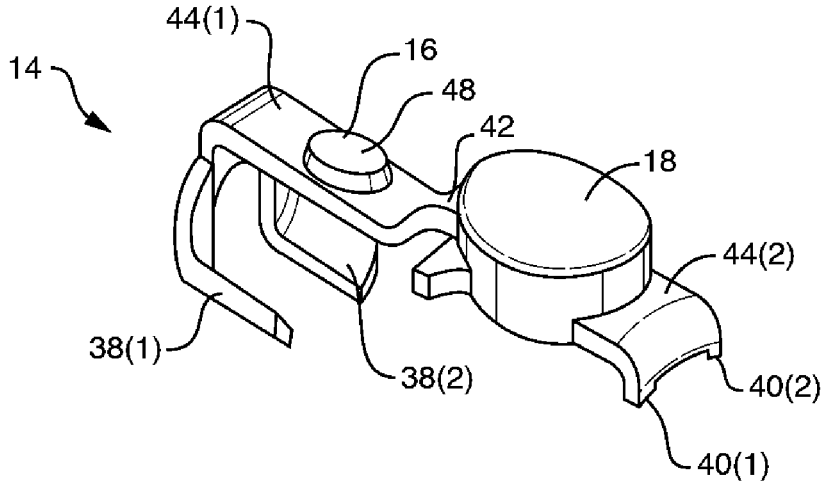
FIG. 4A is a perspective view of a latch assembly in accordance with embodiments of the present invention.
Figure 4B:
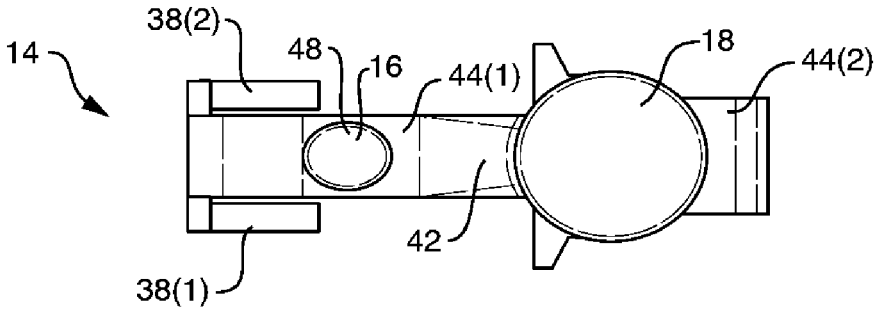
FIG. 4B is a top view of the latch assembly shown in FIG. 4A.
Figure 4C:
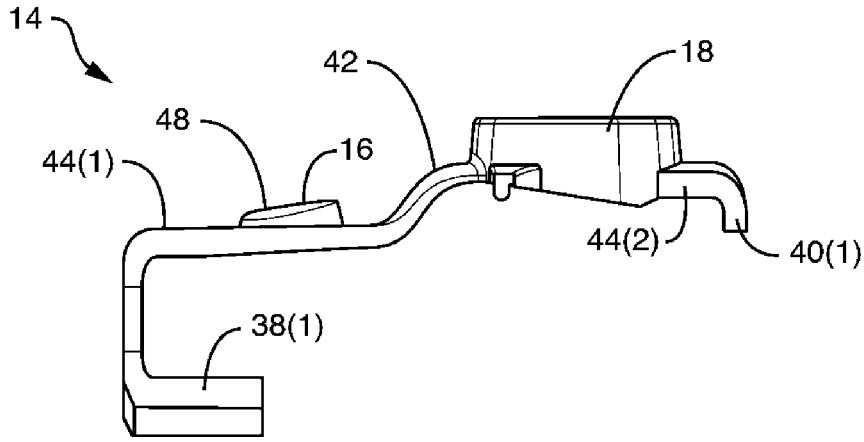
FIG. 4C is a side view of the latch assembly shown in FIG. 4A.
Figure 4D:
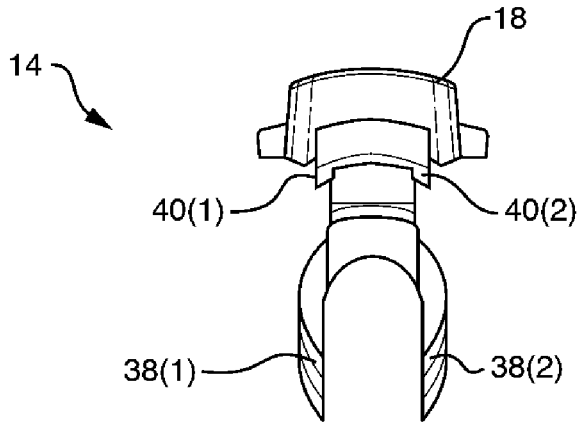
FIG. 4D is an end view of the latch assembly shown in FIG. 4A.
Figure 5:
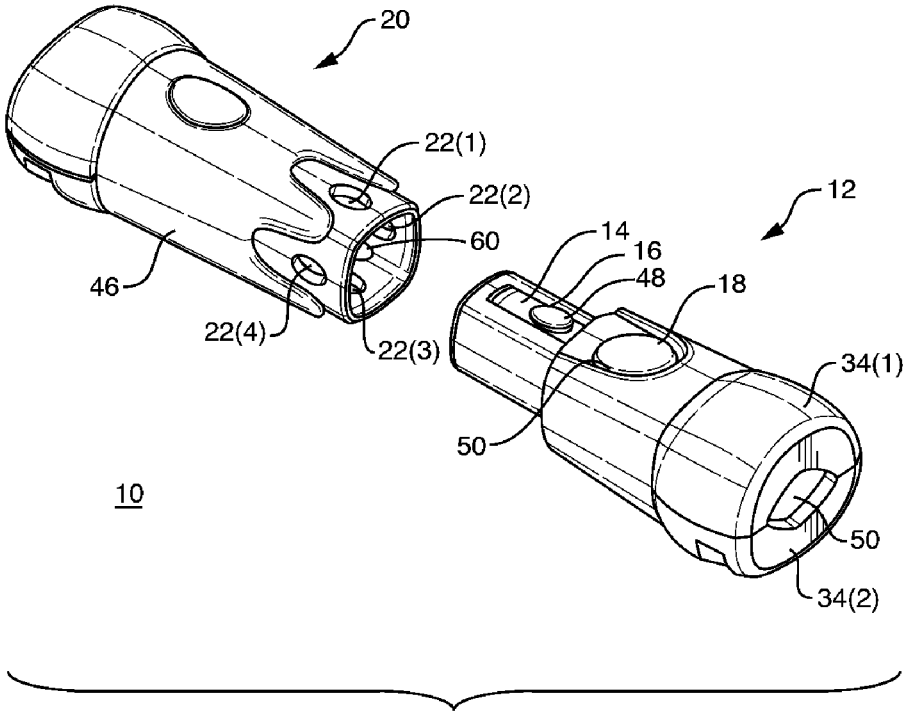
FIG. 5 is a perspective view of a single pole, connector system with a male connector and a female connector with a latch assembly in accordance with embodiments of the present invention.
Figure 6:
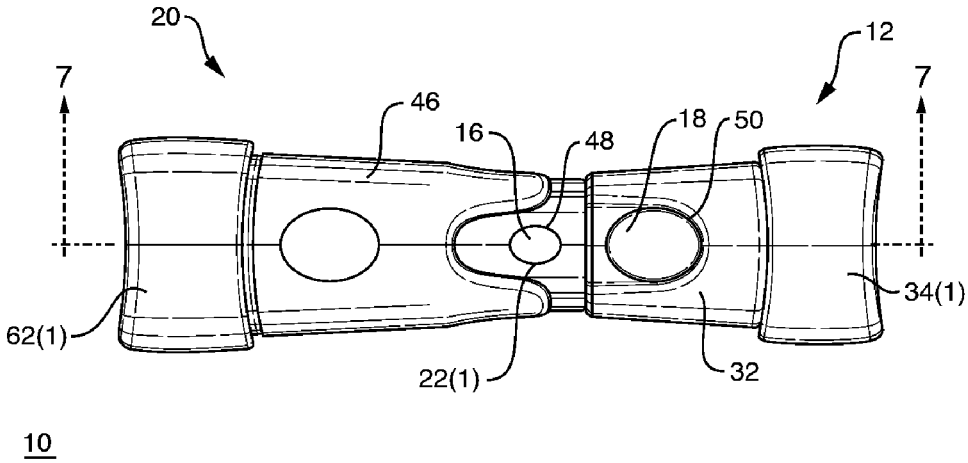
FIG. 6 is a top view of the single pole, connector system shown in FIG. 5 with the male and female connectors engaged.
Figure 7:
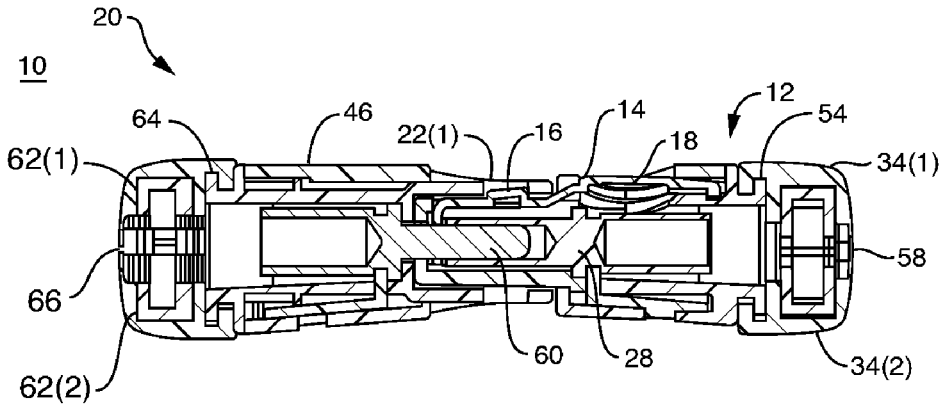
FIG. 7 is a side, cross-sectional view of the single pole, connector system shown in FIG. 6 taken along lines 7—7.
Figure 8A:
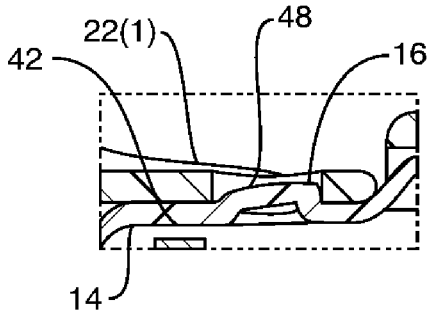
FIG. 8A is an enlarged view of the engagement of the latching assembly in the single pole, connector system shown in FIG. 6.
Figure 8B:
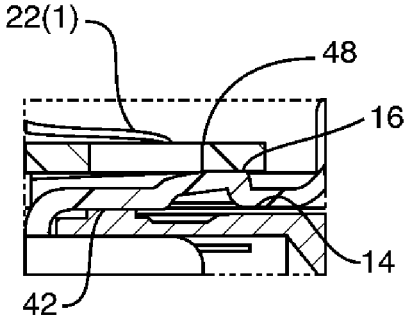
FIG. 8B is an enlarged view of the partial disengagement of the latching assembly in the single pole, connector system shown in FIG. 6.

An electrical connector system 10 in accordance with embodiments of the present invention is illustrated in FIGS. 1–8B. The system 10 includes a female connector 12 with a latch assembly 14 with a projection 16 and an actuation member 18 and a male connector 20 with apertures 22(1)–22(4) in a connector housing 24 for detachably locking with the projection 16, although the system 10 can have other numbers and types of components and elements in other configurations. The present invention provides a number of advantages including an electrical connection system with a latching assembly which provides a durable and securing detachable locking system.

Referring to FIGS. 1–3 and 5–7, the female connector 12 includes a connector housing 26, a conductive socket contact 28, a keeper 30, the latch assembly 14, a sleeve 32, and strain relief clamp sections 34(1) and 34(2), although the female connector 12 can have other numbers and types of components and elements in other configurations, such as having the latching assembly 14 on a male connector. The conductive socket contact 28 is seated in a passage 36 in the connector housing 26 and is secured in place by the keeper 30, although other types and numbers of conductive members, such as a male conductive pin, can be used, the conductive members can be secured in or to the connector housing in other manners. Additionally, the connector housing 26 can have other shapes and configurations, such as a right angle shaped connector housing or a double pole connector housing.

Referring to FIGS. 1–8B, the latch assembly 14 includes the projection 16, the actuation member 18, front legs 38(1) and 38(2), rear legs 40(1) and 40(2), and beam 42 with section 44(1) and 44(2), although the latch assembly 14 can have other numbers and types of components and elements in other configurations. The front legs 38(1) and 38(2) of the latch assembly 14 extend from the section 40(1) and are seated in the passage 36 and around the front end of the socket contact 28, although the latching assembly 14 can have other numbers and types of legs and can be secured in other manners. The rear legs 40(1) and 40(2) extend from the section 40 and are secured to the connector housing 26, although again the latching assembly 14 can have other numbers and types of legs and can be secured in other manners. By securing the latching assembly 14 at each end, the latching assembly 14 is more durable than prior latching systems.

The beam 42 of the latching assembly 14 extends along and is spaced from the connector housing 26 and includes the section 44(2) which is stepped up from the section 44(2) and is further away from the connector housing 26, although the beam 42 could have other configurations with other numbers and types of sections. The projection 16 is located on the section 44(1) and the actuation member 18 is on the stepped up section 44(2) which act as a spring for both the projection 16 and actuation member 18, although the projection 16 and actuation member 18 could be on other locations on the latching assembly. The top surface 48 of the projection 16 is sloped downwards in a general direction towards the legs 38(1) and 38(2) of the latching assembly 14 to assist the projection 16 in sliding under and along the inner surface of the connector housing 46 of the male connector 20, although the top surface of the projection 16 could have other configurations. With the section 44(2) stepped up from the section 44(1), the latching assembly 14 is prevented from over travel during mating of the connector 12 with the connector 14. Additionally, with the section 44(2) stepped up from the section 44(1), the actuation member 18 has greater leverage to disengage the projection 16 from the aperture 22(1).

The projection 16 has an oval shape and the aperture 22(1) has an oval shape which is slightly larger than the outer perimeter of the projection 16 to permit the projection 16 and the aperture 22(1) to mate, although the projection 16 and aperture 22(1) can have other shapes and sizes. The particular size and shape of the projection 16 can be designed to only mate with the corresponding size and shape aperture 22(1) to help an operator identify which connectors are designed to mate together. When the projection 16 is slid into the aperture 22(1), the latching assembly 14 secured at each end acts like a spring to provide an audible click when mated. This provides a distinct audible click to the operator connecting connecter 12 to connector 20 that a complete connection has been made. Additionally, the projection 16 is visible in the aperture 22(1) to provide a visual indication that a complete connection has been made. In this embodiment, the projection 16 is a different color from the color of the connector housing 46 adjacent the aperture 22(1) to further highlight the mating of the projection 16 in the aperture 22(1), although the projection and connector housing 46 can have other colors and can be the same color. If the projection 16 does not mate in the aperture 22(1), then the connectors will not be locked together and thus the operator will know the connectors are not intended to be mated together.

Referring to FIGS. 1–3 and 5–7, the sleeve 32 has an opening 50 for the actuation member 18 and an opening 52 to the passage 36 in housing 26, although the sleeve 32 could have other shapes and configurations with other numbers of openings. The sleeve 32 is fitted over the beam 42 of the latching assembly 14 and over the connector housing 26, although the sleeve 32 can be mounted in other manners.

The strain relief clamp sections 34(1) and 34(2) are secured together and around an end 54 of the housing 26 by screws 56, although other types and numbers of elements can be connected to end 54 of the housing 26 and can be secured in other manners. A passage 58 extends through the strain relief clamp sections 34(1) and 34(2) to provide a passage 58 for a connector cable which is coupled to the conductive socket contact 28.

Referring to FIGS. 5–8B, the male connector 20 includes the connector housing 46 with the plurality of apertures 22(1)–22(4) about an outer surface of the housing 46 and a conductive pin 60 in the housing 46, although the male connector 20 can have other numbers and types of components and elements, such as one or other numbers of apertures, in other configurations.

The strain relief clamp sections 62(1) and 62(2) are secured together and around an end 64 of the housing 46, although other types and numbers of elements can be connected to end 64 of the housing 46. A passage 66 extends through the clamp sections 62(1) and 62(2) to provide a passage 66 for a connector cable which is coupled to the conductive pin 60.

The operation of the electrical connector system 10 will now be described with reference to FIGS. 5–8B below. When the female connector 12 begins to slide into the male connector 20 to mate, the conductive pin 60 begins to slide into the socket contact 28. At the same time, the top surface 48 of the projection 16 of the latching assembly 14 is sloped to easily slide under the outer surface of the connector housing 46. As the projection 16 slides under the outer surface of the housing 46, the beam 42 is compressed in a direction towards the conductive socket contact 28 as shown in greater detail in FIG. 8B.

When the projection 16 of the latching assembly 14 reaches the aperture 22(1) in the connector housing 46, the conductive pin 60 is fully and completely mated in the socket contact 28. Additionally, the biased beam 42 is released causing the projection 16 to snap into the aperture 22(1) providing an audible click to the operator that a completed connection has been made. Further, the projection 16 is visible in the aperture 22(1) also indicating to the operator that a completed connection has been made. When the projection 16 is in the aperture 22(1), the connectors 12 and 20 are detachably locked together and can not be pulled back apart without use of the actuation member 18 to provide an indication that the correct connectors 12 and 20 are connected together. If the connectors 12 and 20 are not locked together when fully mated, then the connectors 12 and 20 are not intended to be coupled together.

With the present invention, if the projection 16 on one connector does not substantially match the shape and size of the aperture 22(1) on the other connector, then the projection 16 is not designed to mate with the aperture 22(1) and the connectors are not locked and can be pulled apart. Additionally, if the connectors are not designed to be mated, then the operator will not hear the audible click that which occurs when the projection 16 mates with the aperture 22(1) or see the projection 16 seated in the aperture 22(1).

To release the female connector 12 from the male connector 20, the actuation member 20 is pressed in which biases the section 44(2) of the beam 42 towards the connector housing 26. Biasing section 44(2) biases section 44(1) in a direction towards the conductive socket contact 28 which withdraws the projection 16 from the aperture 22(1). With the projection 16 withdrawn from the aperture 22(1), the conductive pin 60 can be withdrawn from the socket contact 28 and the female connector 12 can be withdrawn from the male connector 20.

Accordingly, with the present invention an electrical connection system with latching assembly which provides a durable and securing detachable locking system. The latching assembly is more durable than prior latches because the opposing ends of the latching assembly are secured. Additionally, the latching assembly prevents over travel during mating and provides increase leverage for actuation of the latching assembly with a stepped beam. Further, the present invention uses a mating system with the latching assembly to ensure the correct electrical connectors are mated together. The present invention also provides an operator an audible and visual indication of a completed electrical connection.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed:

1. An electrical connector system comprising:

a first connector housing with a first conductive member and at least one latch assembly connected at each end to the first connector housing, said latch assembly comrising a flexible beam suspended between the ends and spaced out from the first connector housing, wherein the beam has a projection and an actuation member which extends out from the beam; and a second connector housing with a second conductive member and with an aperture shaped and sized to detachably mate with the projection when the second connector housing with the second member is mated with the first connector housing with the first conductive member, wherein the actuation member is used to release the projection from the aperture when engaged.

2. The system as set forth in claim 1 wherein the beam of the latching assembly comprises a flexible beam with at least two sections with the projection on one of the sections and the actuation member on the other one of the sections, wherein the section with the actuation member is spaced further away from the first connector housing than the section with projection.

3. The system as set forth in claim 1 wherein the projection on the latching assembly in the first connector and the aperture in the second connector housing have substantially similar size and shape such that the projection mates with the aperture.

4. The system as set forth in claim 1 further comprising a plurality of the apertures spaced around the second connector housing, wherein the projection on the latching assembly can mate with any of the plurality of apertures.

5. The system as set forth in claim 1 wherein the latching assembly further comprises one or more legs at each end of the latching assembly which are each secured to the first connector housing.

6. The system as set forth in claim 1 further comprising a sleeve which fits over a beam of the first connector housing and the latching assembly, wherein the projection remains exposed and the sleeve has an opening for the actuation member.

7. The system as set forth in claim 1 wherein the first connector housing with the first conductive member comprises one of a male connector and a female connector and the second connector housing with the second conductive member comprises the other one of the male connector and the female connector.

8. The system as set forth in claim 1 wherein the first connector housing with the first conductive member and the second connector housing with the second conductive member each comprise a genderless connector.

9. The system as set forth in claim 1 wherein the mating of the projection in the aperture provides an audible and visual indication of a completed electrical connection.

10. The system as set forth in claim 1 wherein a surface of the projection which engages an inner surface of the second connector housing is sloped.

* * * * *